US006364065B1

(12) United States Patent
Hikita

(10) Patent No.: US 6,364,065 B1
(45) Date of Patent: Apr. 2, 2002

(54) ELEVATOR SYSTEM CONTROLLER AND METHOD OF CONTROLLING ELEVATOR SYSTEM WITH TWO ELEVATOR CARS IN SINGLE SHAFT

(75) Inventor: Shiro Hikita, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/688,193

(22) Filed: Oct. 16, 2000

(30) Foreign Application Priority Data

Nov. 5, 1999 (JP) ..... 11-315075

(51) Int. Cl.[7] ..... B66B 1/18
(52) U.S. Cl. ..... 187/382; 187/902
(58) Field of Search ..... 187/380, 382, 187/384, 388, 354, 902

(56) References Cited

U.S. PATENT DOCUMENTS

| | | | | |
|---|---|---|---|---|
| 5,419,414 A | * | 5/1995 | Sakita | 187/391 |
| 5,482,143 A | * | 1/1996 | Saito | 187/394 |
| 5,663,538 A | * | 9/1997 | Sakita | 187/382 |
| 5,823,299 A | * | 10/1998 | Wierschke et al. | 187/277 |
| 5,865,274 A | | 2/1999 | Kiji et al. | 187/380 |
| 5,877,462 A | * | 3/1999 | Chenais | 187/249 |
| 6,273,217 B1 | * | 8/2001 | Hikita | 187/388 |

FOREIGN PATENT DOCUMENTS

| | | |
|---|---|---|
| JP | 59-153773 | 9/1984 |
| JP | 10-310337 | 11/1998 |

* cited by examiner

*Primary Examiner*—Jonathan Salata
(74) *Attorney, Agent, or Firm*—Leydig, Voit, & Mayer, Ltd.

(57) ABSTRACT

An elevator system controller for efficient group supervisory control while avoiding collisions between two elevator cars in service in a single elevator shaft. The elevator system controller includes a risk calculating unit for calculating a risk of a collision between elevator cars in the same shaft when the elevator cars are responding to a new call for service, a car assigning unit for assignment of an elevator car to respond to the new call based on the risk of collision, and an operation control unit for controlling operation of the elevator cars based on the assignment by the car assigning unit. The risk of collision is calculated for each car, and the risk is recalculated based on a possibility of a withdrawal of one of the elevator cars to a position in the shaft where no collision can occur, based on a predicted arrival time of a car at the floor requiring service. Cars that have high risks of collision when the remaining cars in the same shaft cannot be withdrawn in time to a safe spot are removed as candidates for assignment to respond to the new call. An evaluation is carried out using several evaluation indexes, in addition to the risk of collision, to decide which car is to be assigned to respond to the new call. If a determination of a traffic condition indicates low usage of the elevator cars, one car in each shaft is forwarded to a rest position and paused.

11 Claims, 4 Drawing Sheets

ELEVATOR SYSTEM CONTROLLER AND METHOD OF CONTROLLING ELEVATOR SYSTEM WITH TWO ELEVATOR CARS IN SINGLE SHAFT

BACKGROUND OF THE INVENTION

1. Field of the Invention

The present invention relates to a controller for an elevator system having at least one elevator shaft and in which two elevator cars are in service in each shaft.

2. Description of Related Art

In general, an elevator system has one elevator car in each elevator shaft. There has been proposed, however, an elevator system having two elevator cars in each shaft.

For a conventional elevator system including multiple elevator cars and elevator shafts with a single elevator car in each shaft, "group supervisory control" is usually used to control assignments of particular elevator cars to respond to calls at floors served by the elevators. Group supervisory control has also been proposed for an elevator system in which two cars are in service in each shaft. In this case, however, control to avoid a collision between cars in service in the same shaft is required. Group supervisory control units with a collision avoidance feature have been proposed in Japanese Unexamined Patent Publications Hei. 9-272662 and Hei. 8-133611.

Japanese Unexamined Patent Publication Hei. 9-272662 discloses a "ropeless" elevator system in which elevator cars can be moved vertically and horizontally. An elevator car having no call to which to respond is stopped or moved to the side in a shaft to avoid a collision with a car traveling vertically in the shaft.

Japanese Unexamined Patent Publication Hei. 8-133611 discloses setting aside a section of a shaft only for a certain elevator car and prohibiting entry of another car in this section. A controller is provided to stop another elevator car from entering the section set aside.

The prior art techniques described above pose the following problems.

The group supervisory controller described in the former publication is not effective for a system that is incapable of moving to a side path an elevator car not assigned to respond to a call. Furthermore, if an elevator car having no call is not moved to a side path, then that car is simply stopped in the shaft, making efficient operation of the cars impossible.

The group supervisory controller disclosed in the latter publication stops an elevator car not assigned to respond to a call by assigning a provisional call to the elevator car before a no-entry section of the elevator shaft is reached, making efficient operation of the elevator cars impossible.

SUMMARY OF THE INVENTION

The present invention has been made with a view toward solving the problems described above, and it is an object of the present invention to provide an elevator system controller and method producing more efficient group supervisory control of an elevator system including two elevator cars in each elevator shaft while avoiding a collision between elevator cars.

According to one aspect of the present invention, there is provided an elevator system controller for controlling an elevator system including a plurality of elevator shafts and two elevator cars in service in each shaft comprising a risk calculating unit for calculating risk of a collision between two elevator cars in a single elevator shaft when one of the elevator cars is responding to a new call for service; a car assigning unit for assignment of an elevator car to respond to the new call based on the risk of a collision; and an operation control unit for controlling operation of the elevator cars based on the assignment by the car assigning unit.

In a preferred form, the risk calculating unit calculates, for each elevator car in the elevator system, probability of a collision between elevator cars in a single shaft as the risk; calculates a possibility of withdrawal of a second car in an elevator shaft including first and second elevator cars, to a location where no collision will occur, when the first elevator car has a risk of collision larger than a threshold value; and recalculates the risk of collision of the first and second elevator cars in the elevator shaft based on the possibility of withdrawal of the second car to the location where no collision will occur.

In another preferred form, the car assigning unit deletes the first elevator car from potential assignment for response to the new call if the first elevator car has a risk of collision larger than the threshold value and if the second car cannot be withdrawn to the location where no collision will occur.

In yet another preferred form, the possibility of withdrawal of the second elevator car to the location where no collision will occur is based on a predicted arrival time of each of the elevator cars in the elevator system at a floor where the new call has been issued.

In a further preferred form, the car assigning unit assigns an elevator car to respond to the new call based on an evaluation index that includes at least waiting time for arrival of an elevator car in response to the new call, prediction error, and passenger load in a car, in addition to the risk of collision.

In a still further preferred form, the elevator system controller comprises a traffic condition determining unit for determining traffic condition of the elevator system, and wherein the operation control unit forwards some cars to floors to pause, based on the traffic condition.

According to a second aspect of the invention, a method of controlling an elevator system including a plurality of elevator shafts and two elevator cars in service in each shaft comprises calculating risk of a collision between two elevator cars in a single elevator shaft when one of the elevator cars responding to a new call for service; assigning an elevator car to respond to the new call based on the risk of a collision; and controlling operation of the elevator cars based the elevator car assigned.

In a preferred form, the method includes calculating, for each elevator car in an elevator shaft, probability of a collision between elevator cars in a single shaft as the risk; calculating a possibility of withdrawal of a second car in an elevator shaft including first and second elevator cars, to a location where no collision will occur, when the first elevator car has a risk of collision larger than a threshold value; and recalculating the risk of collision of the first and second elevator cars in the elevator shaft based on the possibility of withdrawal of the second elevator car to the location where no collision will occur.

In another preferred form, the method includes deleting the first elevator car from potential assignment for response to the new call if the first elevator car has a risk of collision larger than the threshold value and if the second car cannot be withdrawn to the location where no collision will occur.

In a further preferred form, the method comprises basing the possibility of withdrawal of the second elevator car to the location where no collision will occur on a predicted arrival time of each of the elevator cars in the elevator system at a floor where the new call has been issued.

In yet another preferred form, the method comprises assigning an elevator car to respond to the new call based on an evaluation index that includes at least waiting time for arrival of an elevator car in response to the new call, risk prediction error, and passenger load in a car, in addition to the risk of collision.

In still another preferred form, the method comprises determining traffic condition of the elevator system and forwarding some cars to floors to pause, based on the traffic condition.

DESCRIPTION OF THE PREFERRED EMBODIMENTS

An embodiment of the present invention is now described in conjunction with the accompanying drawings. FIGS. 1 through 4 illustrate the structure and operation of an embodiment of an elevator system controller in accordance with the present invention. In the illustrated example of an elevator system controller according to the invention, the elevator system has a bank of elevator shafts with two elevator cars in service in each of the shafts, as shown in FIG. 2.

Figure 1:
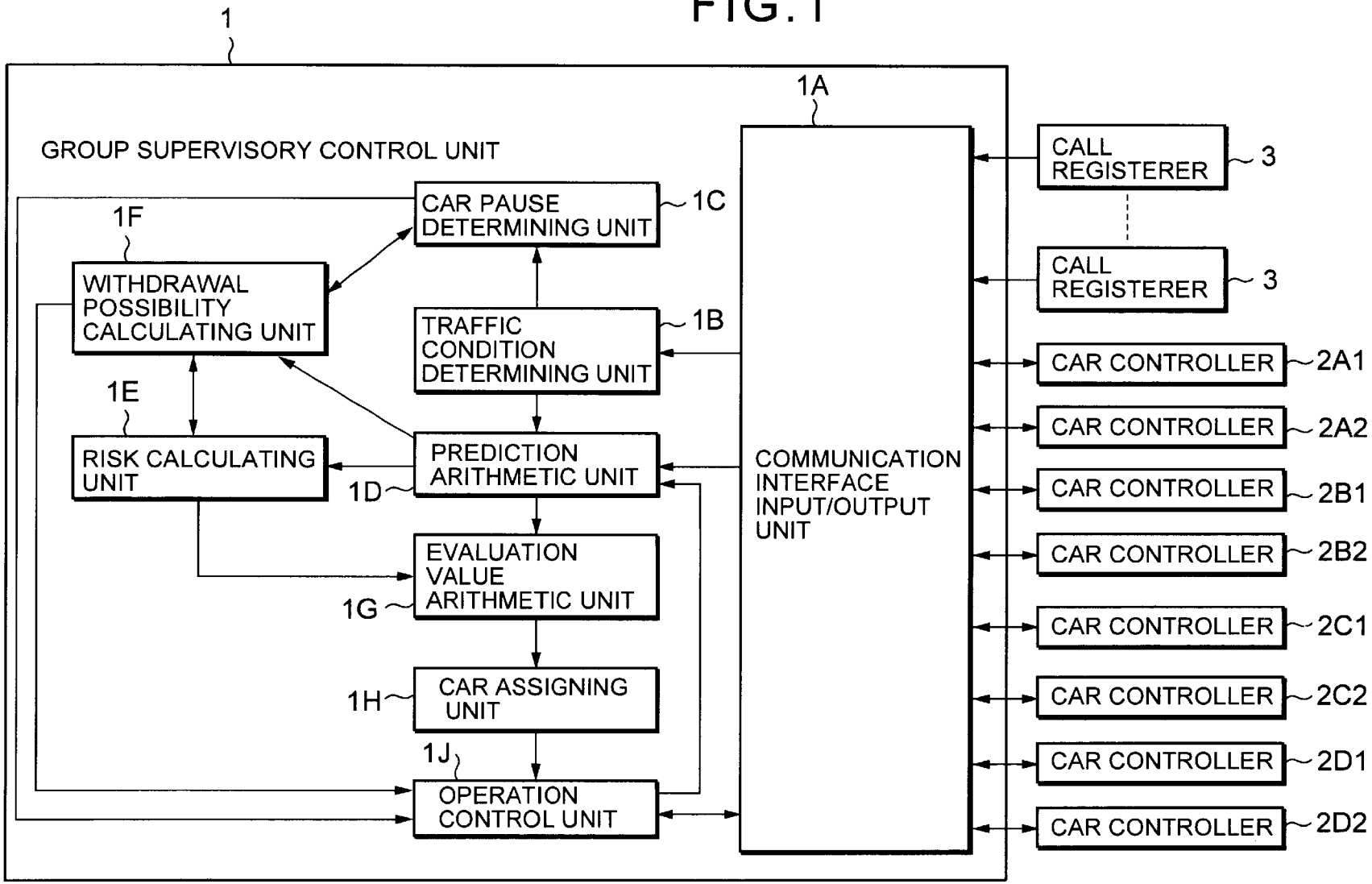
FIG. 1 is a block diagram showing an embodiment of an elevator system controller in accordance with the present invention.
Figure 2:
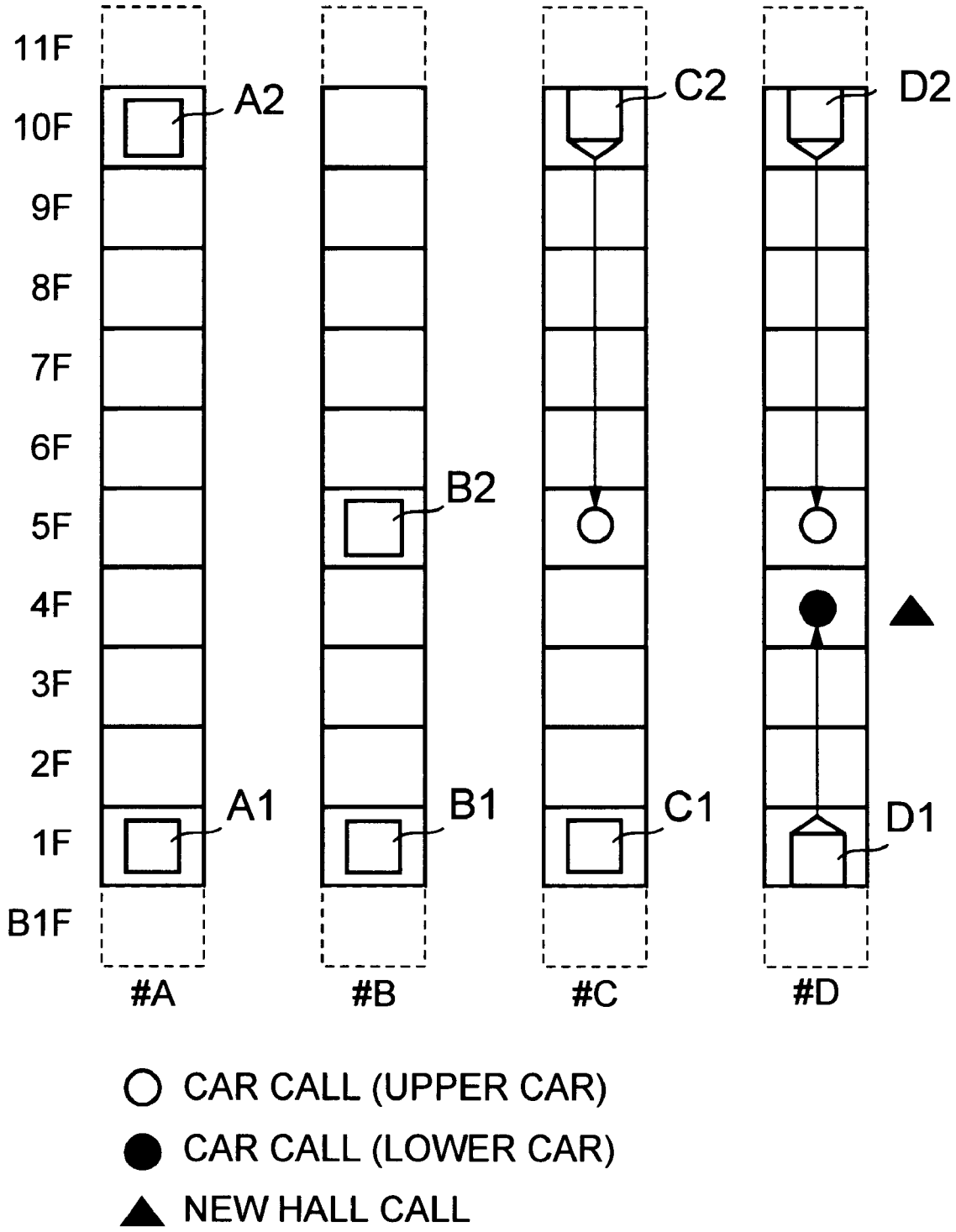
FIG. 2 is an operation status chart of an elevator system to which the elevator system controller shown in FIG. 1 is applied.

The embodiment of the elevator control system shown schematically in FIG. 1 includes a group supervisory control unit 1 for efficiently controlling a plurality of elevator cars. Car controllers 2A1 through 2D2 control elevator cars Al through D2 shown in FIG. 2. A conventional call registerer 3, usually UP/DOWN hall call buttons, is installed at each floor. The elevator cars A1 and A2, B1 and B2, C1 and C2, and D1 and D2 shown in FIG. 2 are the cars respectively in service in elevator shafts #A, #B, #C, and #D and controlled by controllers 2A1, 2A2, 2B1, 2B2, 2C1, 2C2, 2D1, and 2D2, respectively. When a hall call, summoning an elevator, indicated by new hall call 21 in FIG. 2, is registered through a call registerer 3 installed on a particular floor, one of the cars A1 through D2 is assigned by the control unit 1 to respond to the call.

FIG. 2 shows an example with four shafts and two cars in service in each shaft; however, the number of the shafts and the number of the cars in each shaft is not limited to the illustrated embodiment. In conventional group supervisory control, the number of shafts is up to about eight for the convenience of passengers, rather than being limited by the control itself. The number of elevator cars in a shaft may be chosen depending upon elevator traffic. In the example, two cars are provided in each shaft for simplicity of explanation.

The group supervisory controller 1 of FIG. 1 includes a communication interface input/output unit 1A, a traffic condition determining unit 1B, a car pause determining unit 1C, a prediction arithmetic unit 1D, a risk calculating unit 1E, a withdrawal possibility calculating unit 1F, an evaluation value arithmetic unit 1G, a car assigning unit 1H, and an operation control unit 1J. The communication interface input/output unit 1A provides communication and data transfer between the call registerers 3 and the car controllers 2A1 through 2D2. The traffic condition determining unit 1B determines traffic conditions in a building with respect to the elevator system primarily from the number of hall calls registered and requesting elevator service, and elevator car conditions. The car pause determining unit 1C determines whether one or both elevator cars in each shaft should be paused based on a determination of the traffic condition determining unit 1B. The prediction arithmetic unit 1D assumes that an elevator car has been assigned to each new call and estimates an arrival time of the car and predicts loading of the car by passengers. The risk calculating unit 1E assumes that when an elevator car in a shaft has been assigned to respond to a call that the other car in the same shaft is not assigned to respond, and calculates a risk of a collision between these two cars. The withdrawal possibility calculating unit 1F determines whether a car can be withdrawn to a different location if there is a risk of a collision between elevator cars in the same shaft in order to reduce the collision risk.

The evaluation value arithmetic unit 1G performs a comprehensive evaluation to produce an evaluation index for each elevator car. The evaluation index includes waiting time for a passenger who has entered a hall call, prediction error, and passenger load in an elevator car, in addition to the risk of a collision. The car assigning unit 1H makes a final selection of an elevator car to be assigned to respond to a hall call based on a computation by the evaluation value arithmetic unit. The operation control unit 1J issues commands for forwarding or pausing of an elevator car based on an assignment command, withdrawal of an elevator car, or an interruption of response to a hall call based on a selection result provided by the car assigning unit 1H, and a determination by the car pause determining unit 1C based on a determination result provided by the traffic condition determining unit 1B.

Figure 3:
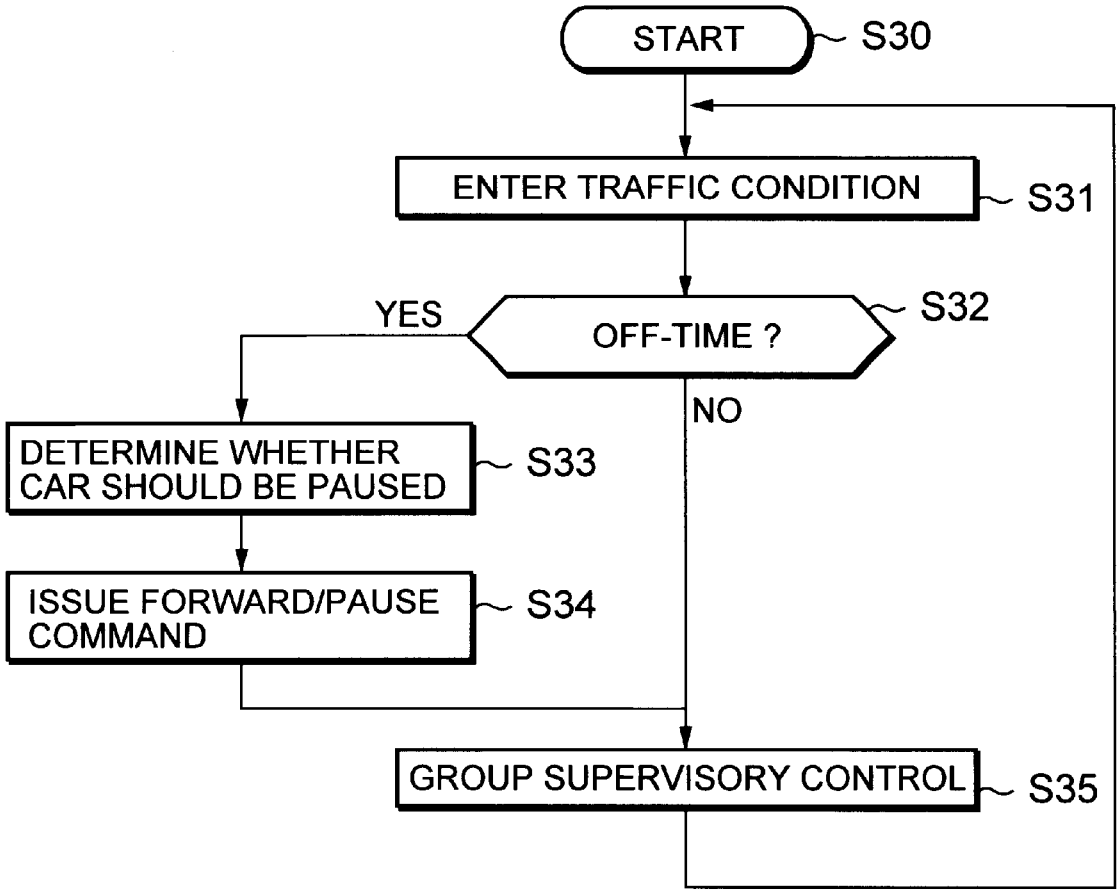
FIG. 3 is a flowchart schematically illustrating a procedure for forwarding and pausing an elevator car in an embodiment of the elevator system controller in accordance with the present invention.

Operation of the depicted embodiment of the invention is described with reference to FIG. 3 and FIG. 4. Referring to FIG. 3, first, in step S31, a traffic condition of the elevator system is entered through the communication interface input/output unit 1A, and the traffic condition determining unit 1B determines the traffic condition for an elevator system. The traffic condition refers to, for example, the number of passengers getting on and off at each floor for the past five minutes or so. Based on the number of passengers getting on and off, the traffic condition is determined. In conventional elevator group supervisory control systems, whether the total number of passengers getting on and off is smaller than a threshold value is used as an index of traffic. Alternatively, the traffic condition is conventionally determined using a neural network. Either of these known techniques may be used in the invention.

If a determination result of the step S31 is "off-time" (if YES in step S32), then the car pause determining unit 1C determines in step S33 whether the other elevator car in the same shaft should be paused, and the operation control unit 1J issues a forward or pause command in step S34 to forward a car or cars specified in the step S33 to a specific position or positions and to pause there.

In determining pausing of the elevator cars in the step S33, the number of elevator cars to be paused may be decided based on, for example, the degree of off-time, namely, traffic volume. In the simplest case, in an off-time, only one car is left operating in each shaft and the remaining cars are paused. In this case, there is no risk of a collision of cars in the shaft, so that the group supervisory control (step S35) is equivalent to that applied to a regular elevator system with one car per shaft. If the determination result in the step S31 is other than off-time (if NO in the step S32), then group supervisory control in which cars are not paused is carried out at the step S35. The determination from steps S31 through S35 may be performed at regular intervals, e.g., every minute, rather than a real-time mode.

Figure 4:
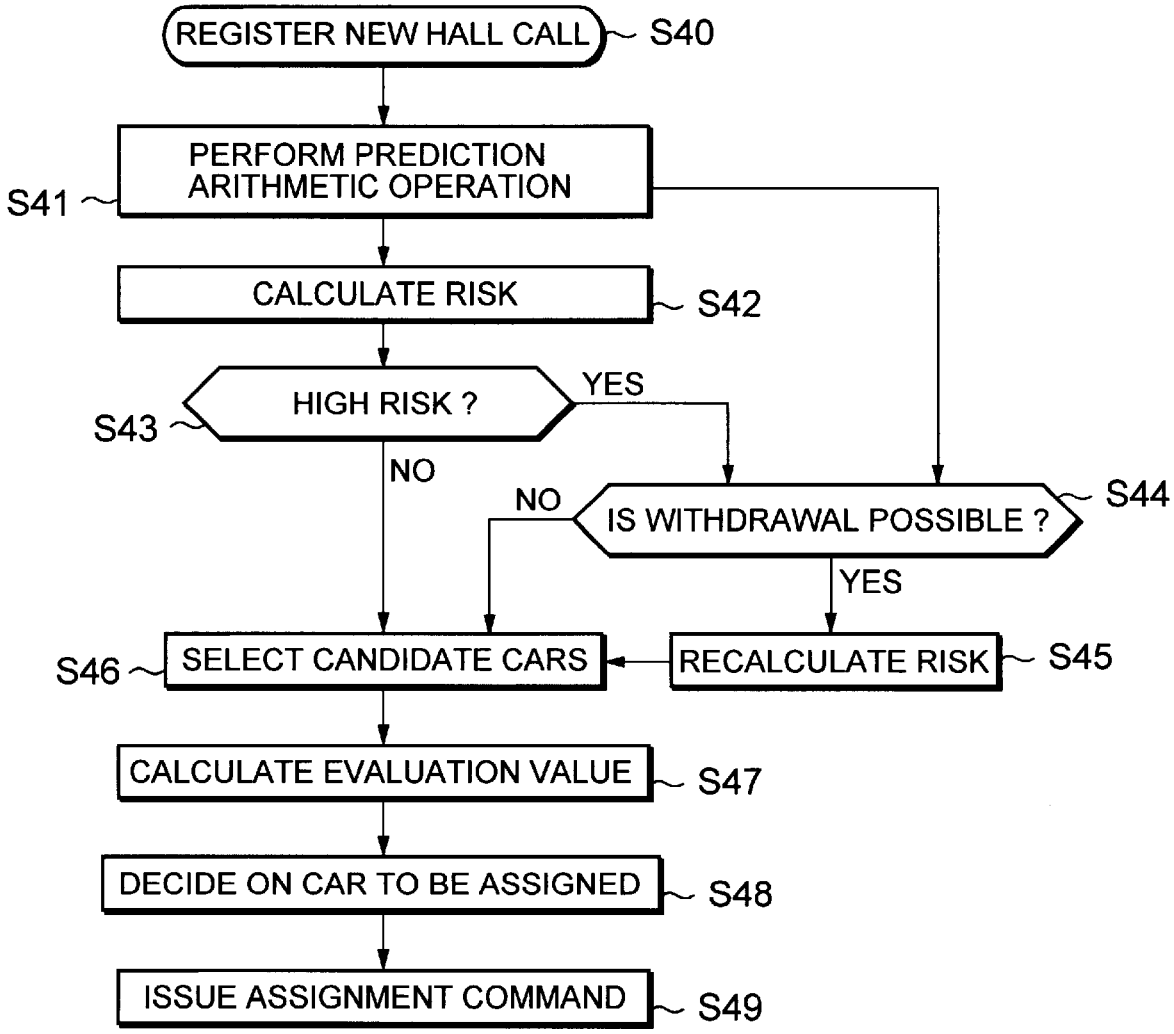
FIG. 4 is a flowchart schematically illustrating an operation of an embodiment of an elevator system controller in accordance with the present invention.

Referring to FIG. 4, in step S40, a new hall call from a call registerer 3 on a floor is input through the communication interface input/output unit 1A. In step S41, the prediction arithmetic unit 1D makes a prediction calculation. The prediction is based on an assumption that an elevator car has been assigned to the new hall call, and the prediction is intended to predict the time required for a car to reach the floor where the new hall call has been registered and also the passenger load in the car when the car arrives at the destination floor. A well-known procedure can be used for this prediction.

Subsequently, in step S42, the risk calculating unit 1E calculates the risk of a collision between elevators cars in the same shaft, assuming that a car has been assigned. The calculation of the risk is explained with reference to FIG. 2. FIG. 2 illustrates an example wherein a new call for ascending (UP) has been issued on a third floor in an elevator system in which two cars (A1, A2, B1, . . . , D2) per shaft are in service in four shafts #A through #D from first to tenth floors. Floors denoted by B1F and 11F in FIG. 2 are floors to which the upper and lower cars in each shaft are respectively paused or withdrawn when not in service. In FIG. 2, the upper and lower cars A1, A2, B1, and B2 in the shafts #A and #B and the lower car C1 of the shaft #C are at rest because they have no registered calls to which to respond at the time illustrated. The upper cars C2 and D2 in the shafts #C and #D and the lower car D1 of the shaft #D respectively have been assigned car calls to which to respond, and are starting to travel in DOWN and UP directions, respectively.

The risk of collision is calculated as follows. In the condition shown in FIG. 2, if the lower elevator car A1 in the shaft #A is assigned to respond to a hall call, then a passenger who gets in the elevator car on the third floor might wish to get off at any of the fourth to tenth floors. A collision may happen only when the passenger is heading toward the tenth floor, not when the lower car A1 goes to a lower floor from the third floor. Hence, the risk in this case can be represented as shown below:

$$\text{Coll.-Degree } (A\mathbf{1})=1/(10-3)=1/7$$

where (Coll.−Degree (car): Risk of car collision).

If the upper car A2 is assigned to respond to a hall call, then the upper car A2 travels from a current position to the third floor, and, after boarding by the passenger, travels in the UP direction. Therefore, if elevator car A2 responds to the hall call, unless the lower car A1 moves, there is no risk of a collision. Hence, the risk is as follows:

$$\text{Coll.-Degree } (A\mathbf{2})=0$$

Similarly, the risk of collision of each car can be calculated as:

| | |
|---|---|
| Coll.-Degree (B1) = 6/7, | Coll.-Degree (B2) = 0 |
| Coll.-Degree (C1) = 6/7, | Coll.-Degree (C2) = 0 |
| Coll.-Degree (D1) = 6/7, | Coll.-Degree (D2) = 1 |

Upon completion of the calculation of the risks of all pairs of elevator cars in each shaft, it is determined in step S43 whether the risk of collision of each car is high. To implement this determination, a threshold value (e.g., Th=0.3) may be set for risk of collision.

If the risk of collision of a car is determined to be high (if YES in the step S43), then the withdrawal possibility calculating unit 1F determines whether the other car in the same shaft can be withdrawn. The following will describe a procedure implemented in step S44.

In the example illustrated in FIG. 2, the elevator cars that are determined to have high risks according to the results of the expressions (1) are B1, C1, D1, and D2. Among these cars, if the car B1 is assigned to respond to the hall call, then it is determined that the car B2 can be withdrawn because it has not been assigned any calls to respond to and can be withdrawn upwardly to an upper floor, including the eleventh floor, as necessary.

In the case of the elevator cars C1 and D1, both upper cars C2 and D2 have been assigned calls for response. In this case, the determination is implemented by using a predicted time required for reaching each floor, which is the computation result of the prediction arithmetic unit 1D. More specifically, predicted arrival times of the upper and lower cars are calculated to decide whether the car to be withdrawn will arrive sooner than the assigned car and has sufficient time for withdrawal before a collision.

The following specific description provides an example. For simplicity of description, the predicted arrival times will be calculated assuming travel time per floor is 2 seconds and stop time is 10 seconds per stop. Thus, the predicted arrival times, in seconds, of the cars will be:

When C1 is assigned:

$$T(C\mathbf{1},\mathbf{5}F)=18,\ T(C\mathbf{2},\mathbf{5}F)=10$$

where (T(car,fl): Predicted time of arrival of car at a floor fl)

When D1 is assigned:

$$T(D\mathbf{1},\mathbf{5}F)=28,\ T(D\mathbf{2},\mathbf{5}F)=10$$

When D2 is assigned:

$$T(D\mathbf{2},\mathbf{4}F)=22,\ T(D\mathbf{1},\mathbf{4}F)=6$$

Furthermore, if it is assumed that the time required for withdrawal is 10 seconds, which is denoted as margin_t=10, then the following relational expressions are established:

When C1 is assigned:

$$T(C\mathbf{1},\mathbf{5}F)<T(C\mathbf{2},\mathbf{5}F)+\text{margin_}t$$

When D1 is assigned:

$$T(D\mathbf{1},\mathbf{5}F)>T(D\mathbf{2},\mathbf{5}F)+\text{margin_}t$$

When D2 is assigned:

$$T(D\mathbf{2},\mathbf{4}F)>T(D\mathbf{1},\mathbf{4}F)+\text{margin_}t$$

Based on the results shown above, it can be determined that the elevator car C2 cannot be withdrawn in time to avoid a collision if the elevator car C1 is assigned to respond to the hall call. The car D2 can be withdrawn if the car D1 is assigned without collision. The car D1 can be withdrawn without a collision if the car D2 is assigned.

Subsequently, in step S45, the risks for the cars that have been determined to be capable of being withdrawn in the step S44 are recalculated. As a method for carrying out the recalculation, for example, the threshold value in the step S43 may be substituted as a penalty requiring a withdrawal. More specifically, in the example shown in FIG. 2, the following applies:

$$\text{Coll.-Degree } (D1)=Th(=0.3),\ \text{Coll.-Degree } (D2)=Th(=0.3)$$

After implementing the procedure from the steps S43 through S45 for each elevator car as described above, candidate elevator cars for response to the hall call are selected in step S46. The candidate cars are the cars that are left after removing the cars found to have high risks of collision as a result of the calculation performed in step S42 or step S45. The threshold value mentioned above is used to determine the magnitude of the risks. In the case shown in FIG. 4, the car C1 is removed, and the remaining cars become the candidate cars.

Subsequently, the evaluation value arithmetic unit 1G calculates evaluation values for the candidate cars in step S47. A variety of evaluation indexes, in addition to the risk, are usable for the calculation of the evaluation value. The evaluation may be performed based on waiting time for car arrival in response to a call that involves mean waiting time, long-wait rate, waiting time distribution, etc. There is also a prediction error evaluation employing an incidence rate of prediction errors in which an unexpected elevator car responds to a call and arrives sooner than an expected elevator car. There is another evaluation method based on a probability of a car becoming full. These evaluation methods are all well known, so that the details of the indexes and the procedures for the evaluation methods are not described here.

For the calculation of a comprehensive evaluation value, the following comprehensive evaluation function, for example, may be used.

Comprehensive evaluation=W1×Evaluation based on waiting time+W2×Evaluation based on prediction error+W3×Evaluation based on car being full+W4×Risk. W1 to W4 are weights assigned based on the importance of each evaluation index component.

In step S48, the evaluation value obtained in the step S47 is comprehensively evaluated, and the elevator car having the best comprehensive evaluation value is selected as the car to be assigned to respond to the hall call. This step is implemented by the car assigning unit 1H.

When the elevator car to be assigned to respond to a hall call is selected by the procedure set forth above, an assignment command is issued in step S49, and a withdrawal command is issued to an elevator car to be withdrawn, if necessary. This step S49 is implemented by the operation control unit 1J.

Thus, an elevator system controller in accordance with the present invention for controlling an elevator system in which two elevator cars are in service in a single shaft includes a risk calculating unit for calculating a risk of a collision between elevator cars in the same shaft when responding to a new call for service; a car assigning unit for assigning an elevator car to respond to the new call based on the risk of collision; and an operation control unit for controlling operation of the assigned elevator car based on the assignment by the car assigning unit. Hence, highest possible operation efficiency can be achieved while reducing risk of collision.

Furthermore, the risk calculating unit may calculate for each elevator car the probability of a collision as the risk, calculate a possibility of withdrawal of a second elevator car in the same shaft to a location where no collision will occur with respect to a car having a collision risk that is larger than a threshold value, and recalculate the risk based on the withdrawal possibility. This arrangement provides that a risk of collision can be predicted accurately, and efficient control can be achieved.

Moreover, the car assigning unit may delete, from potential assignment for response to the new call, a second elevator car having a risk of collision larger than the threshold value if the second car cannot be withdrawn to a safe location. This arrangement minimizes the possibility of a collision between elevator cars in a single shaft.

The possibility of withdrawal of the second car to a sake location may be based on a predicted arrival time of each car at a floor where the new call has been issued. With this arrangement, an arithmetic result of the prediction arithmetic unit can be used, permitting the necessary arithmetic calculation without adding new data.

The car assigning unit may assign an elevator car to respond to the new call based on an evaluation index that includes at least waiting time for arrival of an elevator car at the floor where the new call has been issued, prediction error, and passenger load in a car, in addition to the risk of collision. This evaluation maximizes operation efficiency.

The elevator system controller may further include a traffic condition determining unit for determining traffic condition of the elevator cars, and the operation control unit may forward some elevator cars to floors where they pause, based on a result of the determination. With this arrangement, the possibility of a collision is reduced, since only cars necessary for response need to be operated and that energy saving can be achieved without loss in quality of expected service.

What is claimed is:

1. An elevator system controller for controlling an elevator system including a plurality of elevator shafts and two elevator cars in service in each shaft, the controller comprising:

a risk calculating unit for calculating risk of a collision between two elevator cars in a single elevator shaft when one of the elevator cars is responding to a new call for service, wherein the risk calculation unit:

calculates, for each elevator car in the elevator system, probability of a collision between elevator cars in a single shaft as the risk;

calculates a possibility of withdrawal of a second car in an elevator shaft including first and second elevator cars, to a location where no collision will occur, when the first elevator car has a risk of collision larger than a threshold value; and recalculates the risk of collision of the first and second elevator cars in the elevator shaft based on the possibility of withdrawal of the second car to the location where no collision will occur;

a car assigning unit for assignment of an elevator car to respond to the new call based on the risk of a collision; and an operation control unit for controlling operation of the elevator cars based on the assignment by the car assigning unit.

2. The elevator system controller according to claim 1 wherein the car assigning unit deletes the first elevator car from potential assignment for response to the new call if the first elevator car has a risk of collision larger than the threshold value and if the second car cannot be withdrawn to the location where no collision will occur.

3. The elevator system controller according to claim 1 wherein the possibility of withdrawal of the second elevator car to the location where no collision will occur is based on a predicted arrival time of each of the elevator cars in the elevator system at a floor where the new call has been issued.

4. The elevator system controller according to claim 1 comprising a traffic condition determining unit for determining traffic condition of the elevator system, and wherein the operation control unit forwards some cars to floors to pause, based on the traffic condition.

5. An elevator system controller for controlling an elevator system including a plurality of elevator shafts and two elevator cars in service in each shaft, the controller comprising:

a risk calculating unit for calculating risk of a collision between two elevator cars in a single elevator shaft when one of the elevator cars is responding to a new call for service;

a car assigning unit for assignment of an elevator car to respond to the new call based on the risk of a collision, wherein the car assigning unit assigns an elevator car to respond to the new call based on an evaluation index that includes at least waiting time for arrival of an elevator car in response to the new call, prediction error, and passenger load in a car, in addition to the risk of collision; and an operation control unit for controlling operation of the elevator cars based on the assignment by the car assigning unit.

6. An elevator system controller for controlling an elevator system including a plurality of elevator shafts and two elevator cars in service each shaft, the controller comprising:

a traffic condition determining unit for determining a traffic condition of a first elevator car, based on the number of passengers getting on and off the first elevator car, in each of a plurality of elevator shafts, each shaft including a second elevator car; and an operation control unit for forwarding and pausing each second elevator car to a respective pausing location so that only the first car is operated in a single shaft if the traffic condition of each first car is below a threshold.

7. A method of controlling an elevator system including a plurality of elevator shafts and two elevator cars in service in each shaft, the method comprising:

calculating risk of a collision between two elevator cars in a single elevator shaft when one of the elevator cars is responding to a new call for service, including:

calculating, for each elevator car in an elevator shaft, probability of a collision between elevator cars in a single shaft as the risk;

calculating a possibility of withdrawal of a second car in an elevator shaft including first and second elevator cars, to a location where no collision will occur, when the first elevator car has a risk of collision larger than a threshold value; and recalculating the risk of collision of the first and second elevator cars in the elevator shaft based on the possibility of withdrawal of the second elevator car to the location where no collision will occur;

assigning an elevator car to respond to the new call based on the risk of a collision; and controlling operation of the elevator cars based the elevator car assigned.

8. The method according to claim 7 including deleting the first elevator car from potential assignment for response to the new call if the first elevator car has a risk of collision larger than the threshold value and if the second car cannot be withdrawn to the location where no collision will occur.

9. The method according to claim 7 including basing the possibility of withdrawal of the second elevator car to the location where no collision will occur on a predicted arrival time of each of the elevator cars in the elevator system at a floor where the new call has been issued.

10. The method according to claim 7 including determining traffic condition of the elevator system and forwarding some cars to floors to pause, based on the traffic condition.

11. A method of controlling an elevator system including a plurality of elevator shafts and two elevator cars in service in each shaft, the method comprising:

calculating risk of a collision between two elevator cars in a single elevator shaft when one of the elevator cars is responding to a new call for service;

assigning an elevator car to respond to the new call based on the risk of a collision; and controlling operation of the elevator cars based the elevator car assigned, including assigning an elevator car to respond to the new call based on an evaluation index that includes at least waiting time for arrival of an elevator car in response to the new call, prediction error, and passenger load in a car, in addition to the risk of collision.

* * * * *